US010937362B1

(12) United States Patent
Chen

(10) Patent No.: US 10,937,362 B1
(45) Date of Patent: Mar. 2, 2021

(54) ELECTRONIC APPARATUS AND OPERATING METHOD THEREOF

(71) Applicant: AU Optronics Corporation, Hsin-Chu (TW)

(72) Inventor: Hong Shiung Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/578,600

(22) Filed: Sep. 23, 2019

(51) Int. Cl.
*G09G 3/3225* (2016.01)

(52) U.S. Cl.
CPC ..... *G09G 3/3225* (2013.01); *G09G 2310/08* (2013.01); *G09G 2320/0626* (2013.01)

(58) Field of Classification Search
CPC ..... G09G 3/3225; G09G 2310/08; G09G 2320/0626
See application file for complete search history.

(56) References Cited

U.S. PATENT DOCUMENTS 4,965,561 A * 10/1990 Havel ..... G04G 9/12 340/815.45
2005/0285811 A1* 12/2005 Kawase ..... G02F 1/13336 345/1.1
2006/0262654 A1* 11/2006 Su ..... G04G 9/04 368/223
2007/0280839 A1 12/2007 Furetta
2008/0084381 A1 4/2008 Brewer et al.
2008/0088126 A1* 4/2008 Hoffman ..... H04N 1/4493 283/91
2008/0123473 A1* 5/2008 Ozawa ..... G04B 45/00 368/18
2008/0192067 A1* 8/2008 Barenbrug ..... H04N 13/183 345/607
2010/0020649 A1 1/2010 Kurtze
2012/0182841 A1 7/2012 De Belder
2013/0182072 A1* 7/2013 Seo ..... H04N 13/156 348/43
2014/0340886 A1* 11/2014 Deutsch ..... G02B 6/006 362/231
2015/0029829 A1 1/2015 Spadini
(Continued)

FOREIGN PATENT DOCUMENTS

CN 103853038 A 6/2014
CN 206684491 U 11/2017
(Continued)

OTHER PUBLICATIONS tmall.com, "https://m.tb.cn/h.VdQ2UWD?sm=13f261", 2019.
Intellectual Property Office of Singapore "Office Action" dated Aug. 4, 2020, Intellectual Property Office of Singapore.

*Primary Examiner* — Premal R Patel
(74) *Attorney, Agent, or Firm* — WPAT, PC

(57) ABSTRACT

The present application provides an electronic apparatus, in particular, a wearable electronic apparatus, such as a smart watch. The electronic apparatus comprises one or more ecstatic elements, a light emitting display comprising multiple pixels, and a controller for selectively turning on all or a portion of the covered pixels. The ecstatic elements, such as jewelries, provide visual effect of light. Some of the pixels are covered fully or partly by the one or more ecstatic elements; and a controller selectively turning on all or a particular portion of the pixels based on different operating modes as selected.

19 Claims, 18 Drawing Sheets

(56) References Cited

U.S. PATENT DOCUMENTS

| | | | | |
|---|---|---|---|---|
| 2015/0054800 | A1* | 2/2015 | Kim | G09G 3/3648 345/204 |
| 2015/0116331 | A1* | 4/2015 | Armstrong | A61B 5/7282 345/440 |
| 2016/0109852 | A1* | 4/2016 | Kuwabara | H02J 7/025 368/223 |
| 2017/0270894 | A1* | 9/2017 | Tang | G09G 3/2092 |
| 2018/0164749 | A1* | 6/2018 | Yuen | G04G 9/0035 |
| 2018/0196396 | A1* | 7/2018 | Cho | G04B 1/12 |
| 2018/0242242 | A1* | 8/2018 | Lee | H04W 52/027 |
| 2019/0080673 | A1* | 3/2019 | Li | G09G 5/377 |
| 2019/0082800 | A1* | 3/2019 | Baranski | A44C 5/2071 |

FOREIGN PATENT DOCUMENTS

| | | | | |
|---|---|---|---|---|
| EP | 2056176 | A2 * | 5/2009 | G04G 9/0035 |
| JP | 2001318179 | A | 11/2001 | |
| TW | 450365 | U | 8/2001 | |
| WO | WO2006058684 | | 6/2006 | |
| WO | WO2018006537 | A1 | 1/2018 | |

* cited by examiner

200

200

600

600

600

600

700

700

ELECTRONIC APPARATUS AND OPERATING METHOD THEREOF

BACKGROUND OF THE INVENTION

1. Technical Field

The present disclosure relates to apparatus, and more particularly, to electronic apparatus having decorated light emitting diode display with jewelries or precious stones to spotlight the operations of the apparatus.

2. Description of the Prior Art

Time tracking is essential in the modern society. Various devices, such as clocks and watches, are employed for tracking time. In addition, electronics like laptop computers and smartphones also display time. Clock function can also be found on wearable devices equipped with electronic displays.

Although wearable devices with display are saturated in the market, constrained by industrial design frameworks, almost all of the wearable electronics vendors provide products with similar looks. A rectangular or round flat glass serves as a main input/output (I/O) interface of wearable electronic devices. In the contrary, various traditional watches are designed with sophisticated ecstatic appearance to present or highlight the tastes, values, personalities, professionalism and social status of their owners.

In addition, the wearable electronic devices have quite limited battery power capacity to always lite on display. Furthermore, the wearable electronic devices also have processor and logic circuits to execute downloadable applications and even have antennas for wireless communicating, which further increase the demand for the power consumption.

Hence, there exists a need in the market to provide novel wearable electronics with a designer ecstatic appearance and power-saving functionality.

From the above it is clear that prior art still has shortcomings. In order to solve these problems, efforts have long been made in vain, while ordinary products and methods offering no appropriate structures and methods. Thus, there is a need in the industry for a novel technique that solves these problems.

SUMMARY OF THE INVENTION

The present application provides an electronic apparatus, in particular, a wearable electronic apparatus, such as a smart watch. The electronic apparatus comprises one or more ecstatic elements, a light emitting display comprising multiple pixels, and a controller for selectively turning on all or a portion of the covered pixels.

The ecstatic elements, such as jewelries or precious stones, provide visual effect of light. Some of the pixels are covered fully or partly by the one or more ecstatic elements; and a controller selectively turning on all or a particular portion of the pixels based on different operating modes as selected.

The above description is only an outline of the technical schemes of the present invention. Preferred embodiments of the present invention are provided below in conjunction with the attached drawings to enable one with ordinary skill in the art to better understand said and other objectives, features and advantages of the present invention and to make the present invention accordingly.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
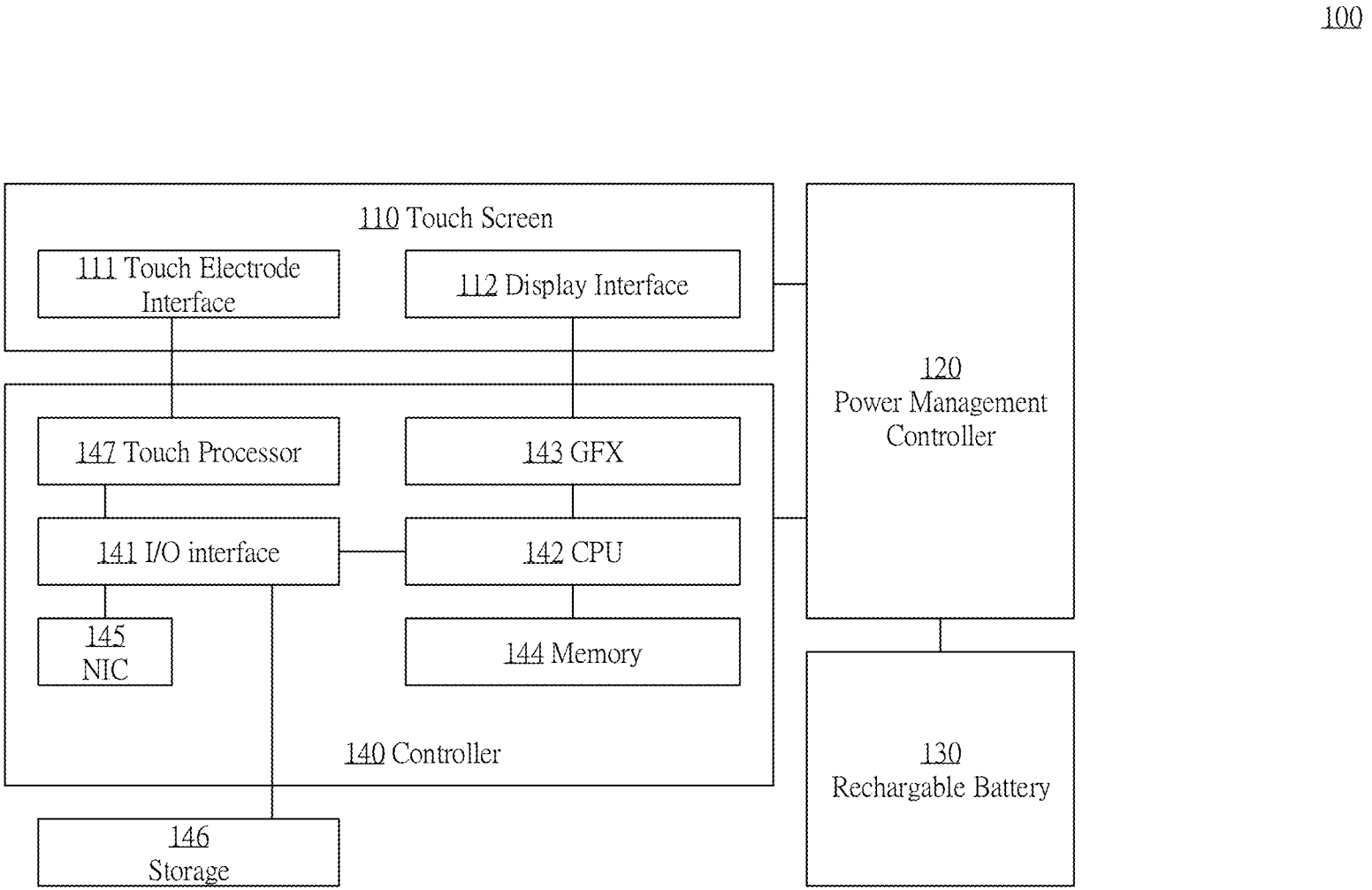
FIG. 1 is a block diagram of a traditional portable, mobile or wearable electronic apparatus 100.

Some embodiments of the present invention are described in details below. However, in addition to the descriptions given below, the present invention can be applicable to other embodiments, and the scope of the present invention is not limited by such, rather by the scope of the claims. Moreover, for better understanding and clarity of the description, some components in the drawings may not necessary be drawn to scale, in which some may be exaggerated relative to others, and irrelevant parts are omitted. The term module refers to a hardware circuit or software executed by a processor.

Please refer to FIG. 1, which illustrates a block diagram of a traditional portable, mobile, or wearable electronic apparatus 100. For examples, the electronic apparatus 100 is smartphone, a pad computer, personal digital assistant, smart watch or any other kinds of electronic apparatus which is designed to be portable. The components of the electronic apparatus 100 are fit into an integrated shell. Besides, the shell is weather-proof, water-proof, dust-proof and/or shake-proof. A string, a strap, and/or watchbands are attached to the shell for wearing.

As shown in FIG. 1, the electronic apparatus 100 comprises a touch screen 110 as an input and output device, a power management controller 120, a battery 130, a controller 140 and a storage device 146. The battery 130 is used to provide electric energy to electronic components of the apparatus 100 via the power management controller 120. Usually, the battery 130 is rechargeable in order to make the design of the apparatus 110 more compact and integrated.

The touch screen 110 is configured to display information and to receive touch and/or pressure inputs from user. Traditional touch screen 110 is comprised of liquid crystal display underneath at least one transparent touch sensitive electrode layer including multiple touch electrodes. A touch electrode interface 111 can be used to connect to the multiple touch electrodes for receiving touch and/or pressure inputs from user. A display interface 112 can be used to receive inputs from a display data source to show the inputted display data. Normally, a transparent and hardened glass made of homogeneous material covers the touch screen 110 in order to protect the electrode layer and the LCD.

Apparently, the apparatus 100 is managed by the controller 140 which further comprises an input/output interface 141, a CPU (central processing unit) 142, a GFX (graphics coprocessor) 143, a memory module 144, a NIC (network interface component) 145 and a touch processor 147. The CPU 142 is configured to execute software or firmware instructions stored in the memory module 144. Usually, an operating system such as Linux, Apple's iOS, iPadOS, watchOS and Google's Android, Wear OS and application programs specifically complied for their respective operating systems are installed in the memory module 144. In some cases, display data are generated by the operating system and/or the application programs executed by the CPU 142. In alternative cases, display data is further optionally processed and formatted by the GFX 143. Eventually, display data being shown are sent to the display interface 112 of the touch screen 110.

Except for the visual output, the I/O interface 141 is responsible for sending and receiving information to and from other components of the apparatus 100. For example, the I/O interface 141 is an interface host compliance with one ore more industrial standards, such as PCI, PCI-Express, SCSI, I2C, Serial ATA, IEEE 1394, USB and etc. Electronic components directly or indirectly connect with the I/O interface 141 are able to communicate with each other. In the embodiment shown in FIG. 1, the CPU 142, the touch processor 147, the NIC 145 and the storage device 146 can transmit and receive information in between via the I/O interface 141.

Touch information gathered by the touch processor 147 includes positions and/or pressure levels with regard to touches or approximations of objects to the touch screen 110. If a stylus is used on the touch screen 110, the touch processor 147 further detects button status, tilt angle, orientation and/or rotation of the stylus via the touch electrode interface 111. Tracks of the touched objects and the styli are maintained by the touch processor 147. All or some of the information obtained by the touch processor 147 send to the CPU 143 for notifying the operating system which distributes the information to subscribed application program for further processing.

Program instructions and data are stored in the storage device 146. The storage device 146 includes hard drive, EEPROM, laser discs or any other non-volatile memory. The NIC 145 is used to communicate with other apparatus wirelessly or via a cable. If the NIC 145 connects to a network infrastructure like Internet, the apparatus 100 is able to connect to a network time server via the network. For example, a time server provides time information via NTP (Network Time Protocol) which is ruled by the RFC 5905 or RFC 1305.

When the apparatus 100 is in normal mode, a program executed by the CPU 142 can show time information on the touch screen 110 and also perform other functions as user selects, such as display images and video, video and audio recording, and executes different APPs. In this normal operation mode, most components of the apparatus 100 consume electric power provided by the battery 130. If the touch screen 110 includes a liquid crystal display, a backlight module of the LCD has to lite on to show information on the touch screen 110. Usually, the LCD consumes a large portion of energy utilized by the apparatus 100.

In order to extend operation period, the apparatus 100 enters idle mode which consumes less energy than the normal mode. Many components of the apparatus 100 are shutdown in the idle mode. Most importantly, the display screen is implemented with OLED, but not limited to. The display can also be implemented with LED, micro LED, or LCD. Under the idle mode, the OLED display is turned off, or if it is implemented with other type of display such as the LCD, the LCD and its backlight module of the touch screen 110 are turned off to preserve energy. Of course, the program executed by the CPU 142 cannot show time information on the touch screen 110. When the display is turned off under the idle mode, the screen is shown as a complete black without any appearance attraction. The present invention provides additional ecstatic look and also enhancing the display reflective luminance by placing precious stones at the predetermined location on the display. Such that the enhanced reflection from the precious stones will become the spotlight of the apparatus's operations when the apparatus is either waked up from idle mode or operating a pre-scheduled task from the idle mode.

In short, user cannot read what time it is when the apparatus 100 is in energy-preserving idle mode. If user wants to know the time, the apparatus 100 has to be waked up to return in the normal mode. Therefore the apparatus 100 cannot save energy when providing time reading.

Figure 2B:
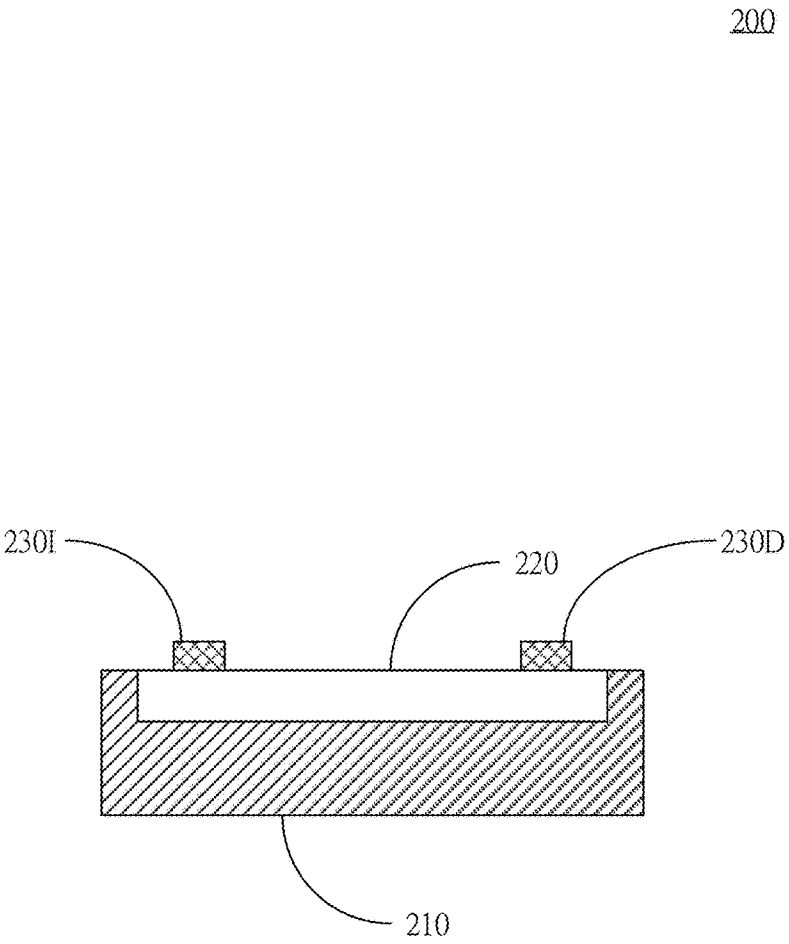
FIGS. 2B-2F illustrates profiles of the apparatus 200 in accordance with embodiments of the present application.
Figure 2A:
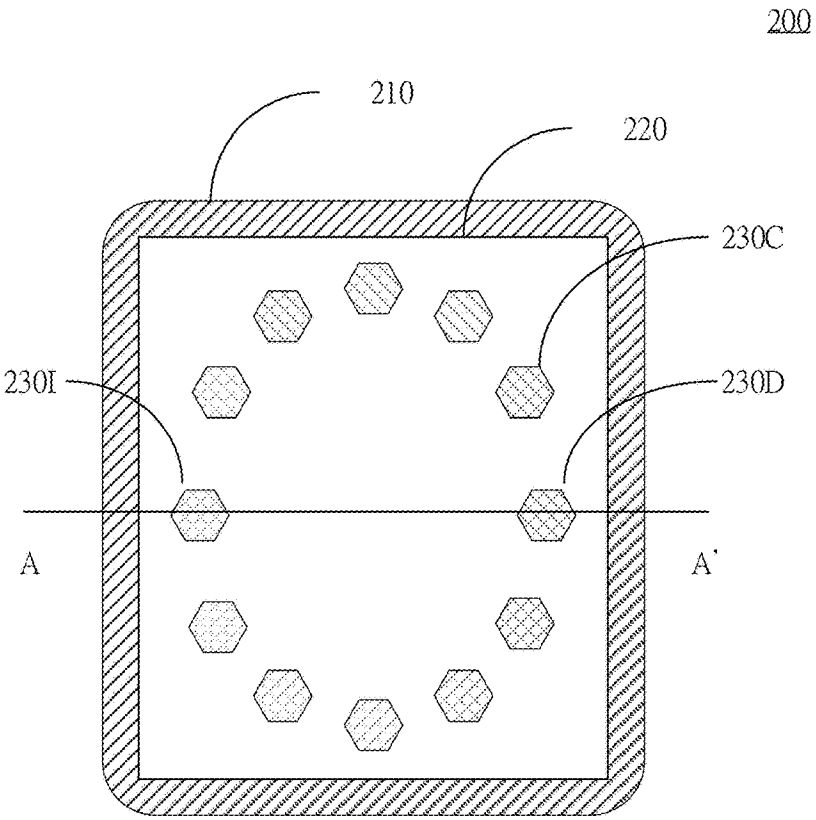
FIG. 2A depicts a top view of an apparatus 200 in accordance with the present application.

Please refer to FIG. 2A, which depicts a top view of an apparatus 200 in accordance with the present application. The apparatus 200 comprises a shell 210 for encapsulating electronic components including an OLED (Organic Light Emitting Diode) display 220. Unlike the LCD has to turn on its backlight module to display entire liquid crystal pixels, the OLED display 220 uses OLED to produce actual images rather than acting as backlighting for other types of display, as in LED-backlit LCD. A single pixel or a group of neighboring pixels of OLED display 220 can be turned on or off individually. Comparing with the LCD of the touch screen 110, pixels of the OLED display 220 can be selectively turned on or off. In short, the OLED display 220 can operate in full screen or in a part of screen.

As shown in FIG. 2A, there are twelve elements 230 arranged in twelve o'clock positions on the OLED display 220. But it is not limited to twelve elements; different embodiments can have more or less elements as desired. The refractive index of the elements 230 is substantially equal to or higher than 1. In the embodiment, the elements 230 are made of precious stone or expensive jewelry such as crystal, diamond, ruby and etc. The jewelry is natural or man-made. The elements 230 can be either same material or different material. Or selected ones of the elements 230 at certain location can be same material as designed or desired by the user.

In some embodiments, the material of the elements 230 is placed differently on the OLED display 220. The elements can further be imbedded within the display 220, or above the display 220 with an additional enhancing or protective layer in between. The number, shape, material, size and/or position of the elements 230 can be tailored to fit in each implementation of the present application. As shown in FIG. 2A, the element 230C acts as the 2 o'clock dial and the element 230D acts as the 3 o'clock dial. These two elements 230C and 230D are different in size, shape and material. Similarly, in some embodiments, any two elements 230 are different in size, shape and/or material.

Just like diamond, the element 230 has many faces to reflect, deflect, diffuse, filter, guide and/or split lights emitted by the OLED display 220 to user. In other words, the element 230 is viewed or considered as a reflector, a deflector, a diffuser, an optical filter, an optical guide and/or an optical splitter. These jewelry-like elements 230 are used to promote tastes, values, personalities, professionalism and social status of user of the apparatus 200. The selections and arrangements of the elements 230 are customized to elevate price and to add value to the apparatus 200.

Twelve elements are positioned in FIG. 2A in order to mimic o'clock dials of a clock. In this embodiment, the whole screen of the OLED display 220 is used to represent one clock. However, the OLED display 220 have other arrangements to represent more clocks. In additional to time clock, the dial represents other instruments such as barometer, depth meter, altitude meter, thermometer and any other instruments having traditional hand indicator.

A line A-A' is placed across the elements 230D and 2301. Please refer to FIGS. 2B-2F, which illustrates profiles of the apparatus 200 in accordance with embodiments of the present application. Please be noted that other electronics components of the apparatus 200 is omitted in FIGS. 2B-2F. As shown in FIG. 2B, the OLED display 220 is embedded in the shell 210. The two elements 230D and 2301 are attached to the top cover of the OLED display 220. Since the elements 230 are almost fully exposed, their values can be seen directly. However, the elements 230 are prone to wear or to lose.

Figure 2D:
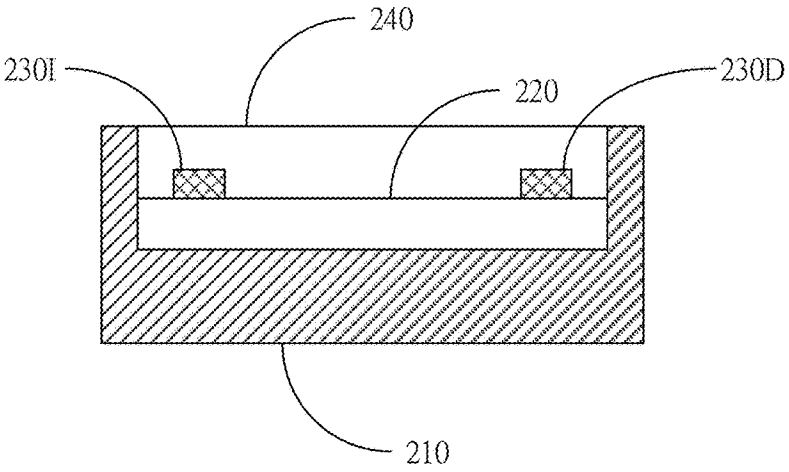
Figure 2C:
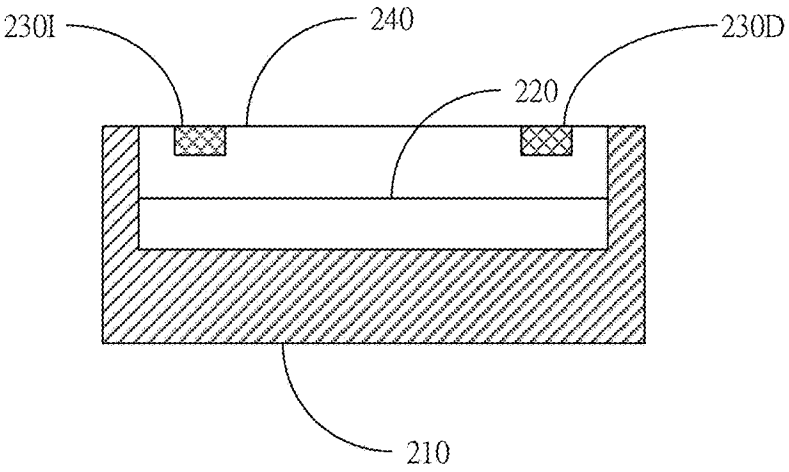

Please refer to FIG. 2C in which the elements 230 are embedded in a transparent cover layer 240 of the OLED display 220. The elements 230 are still exposed partly. Comparing with the embodiment as shown in FIG. 2B, the elements 230 as shown in FIG. 2C are partly protected from wearing and lost. However, it would be costly to customize the arrangements of the elements 230.

Please refer to FIG. 2D in which the elements 230 are completely embedded inside the transparent cover layer 240. Hence, the elements 230 are fully protected from wearing and lost.

Figure 2F:
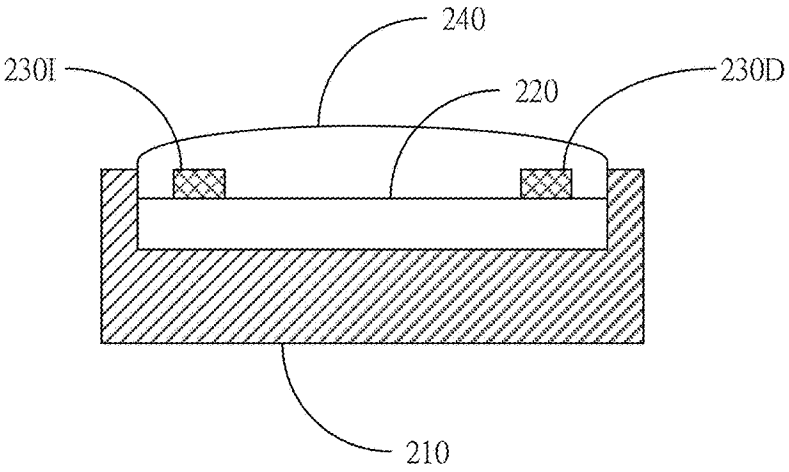
Figure 2E:
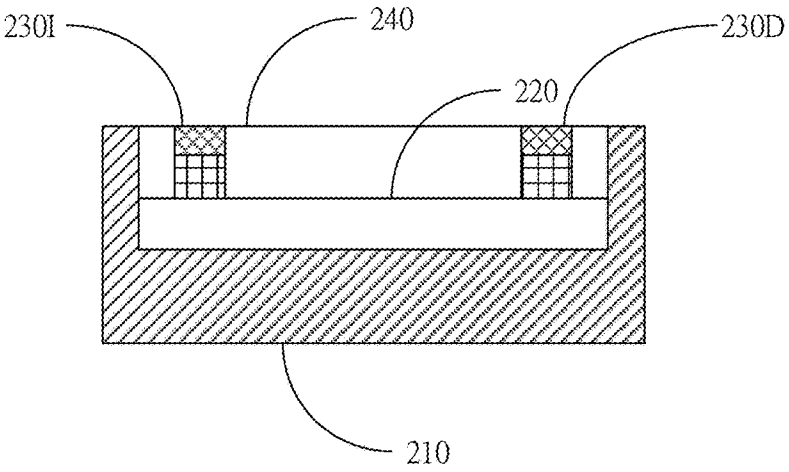

Please refer to FIG. 2E, the elements 230 are composed of two or more different or same materials in layers. Alternatively, the elements 230 comprise composite materials. Composite materials or multilayer structure create more splendid visual effect of the elements. In one embodiment, the material and/or the structure of the element 230 is designed corresponding to one or more specific colors emitted by the underlying OLED pixels to enhance visual effects.

Please refer to FIG. 2F, a top surface of the transparent cover layer 240 of the OLED display 220 is not flat. In one embodiment, the top surface may be curved or bulged in the center. Alternatively, the top surface may comprises one or more curves or bulges upward or downward.

As described with regard to the embodiments as shown in FIGS. 2B-2F, the aforementioned features may be mixed in one implementation. For example, an implementation based on the embodiment as shown in FIG. 2B has multi-layer elements 230 which are described in the embodiment as shown in FIG. 2E. In another example, the element 230D is mounted on top of the transparent cover layer 240 while another element 2301 is fully embedded in the transparent cover layer 240. Embodiments in accordance with the present application may feature any plausible combinations of the technical features shown in the FIGS. 2B-2F.

Figure 3A:
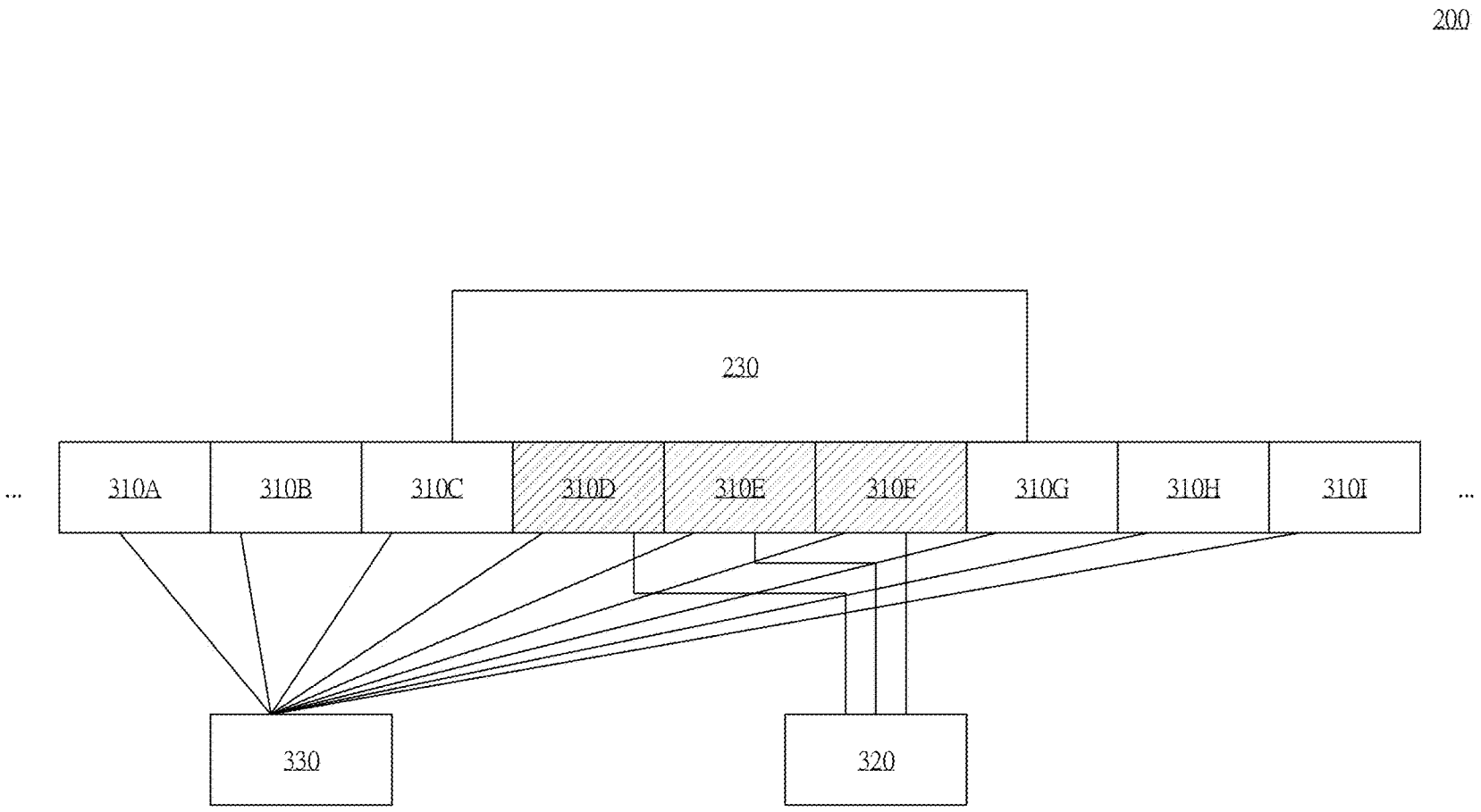
FIG. 3A shows a vertical structure of an apparatus 200 according to an embodiment of the present application.

Please refer to FIG. 3A, which shows a vertical structure of an apparatus 200 according to an embodiment of the present application. The vertical structure as shown in FIG. 3A includes one of the element 230 and multiple pixels 310 of the OLED display 220 vertically beneath the element 230. In order to simplify the drawing, the transparent cover layer 240 is omitted.

In most cases, the size of the element 230 is easily visible. And the OLED display 230 usually have resolutions fine enough to be named after "retina display". It means that the pixel density is so condensed that human eye cannot distinguish one single pixel in a normal reading distance from the display. Therefore, the element 230 covers a plurality of pixels 310. In other words, lights emitted from the plurality of pixels 310 would pass through the element 230 before reaching user's eyes. All of these pixels of the OLED display 220 are coupled to a display controller 330. The pixel 310 comprises one or more OLED to display. For example, each of the pixels 310 comprises at least three OLEDs for emitting red, green and blue lights, respectively. Therefore the display controller 330 can control, code, or modulate light color emitted from each of the pixels 310 by controlling the amplitude emitted from the OLEDs of each of the pixels 310. Of course, the display controller 330 can completely turned off the OLEDs of a pixel 310 to emit no lights. Usually the user sees "black" color if no lights emitted from the pixel 310.

As shown in FIG. 3A, the element 230 covers five pixels 310C through 310G. The pixels 310C and 310G are partly covered by the element 230 and the pixels 310D, 310E and 310F are fully covered by the element 230. And the rest pixels 310A, 310B, 310H and 3101 are not covered. In one embodiment, the display controller 330 turns off all of the pixels 310 except for any combinations of the pixels 310D, 310E and 310F which are covered by the element 230. Therefore, the display controller 330 is able to fully control color emitted to the element 230. Although three pixels 310D, 310E and 310F are covered by the element 230, the display controller 330 turns on one, two or three of the pixels 310D through 310F. In short, the display controller 330 turns on all or part of the pixels 310 fully covered by the element 230.

By turning off part of pixels 310 of the OLED display 220, the display controller 330 saves power. However, the display controller 330 is still powered on for controlling the pixels 310. Alternatively, an element controller 320 connects directly or indirectly to the pixels 310D through 310F which are fully covered by the corresponding element 230. The connections between the pixels 310D through 310F to the element controller 320 are configurable. For example, an interconnection network or a mux is used to fulfill the connections. Similarly, the element controller 320 is able to control, code, or modulate light color emitted from each of the pixels 310 by controlling the amplitude emitted by each of the OLEDs of each of the pixels 310. Alternatively, the element controller 320 is implemented in which no programmable function is provided in order to simplify the implementation and to minimize the energy consumed by the element controller 320. For example, the amplitude emitted by each OLED of the controlled pixel 310 is configured or hardwired in the element controller 320. Only a switch interface of the element controller 320 is provided to turn on or off the pixels 310.

In one embodiment, the display controller 330 enters an energy saving mode by turning off all or part circuits. In this energy saving mode, the display controller 330 relinquishes control to all of the pixels 310 which are turned off. However, the element controller 320 takes over the controls of the connected pixels 310D through 310F. In short, the element controller 320 turns on all or part of the pixels 310 fully covered by the element 230. In one embodiment, if there is a plurality of elements 230, one integrated element controller 320 is used to control all of the pixels 310 which are fully covered by the elements 230. Alternatively, there are a plurality of element controllers 320 which is configured to control one or more pixels 310 which are fully covered by the corresponding elements 230. Because the purposes or functions of the element controller 320 are simpler than those provided by the display controller 330, power consumed by the one or more element controller 320 is much less than the sophisticated display controller 330.

Figure 3B:
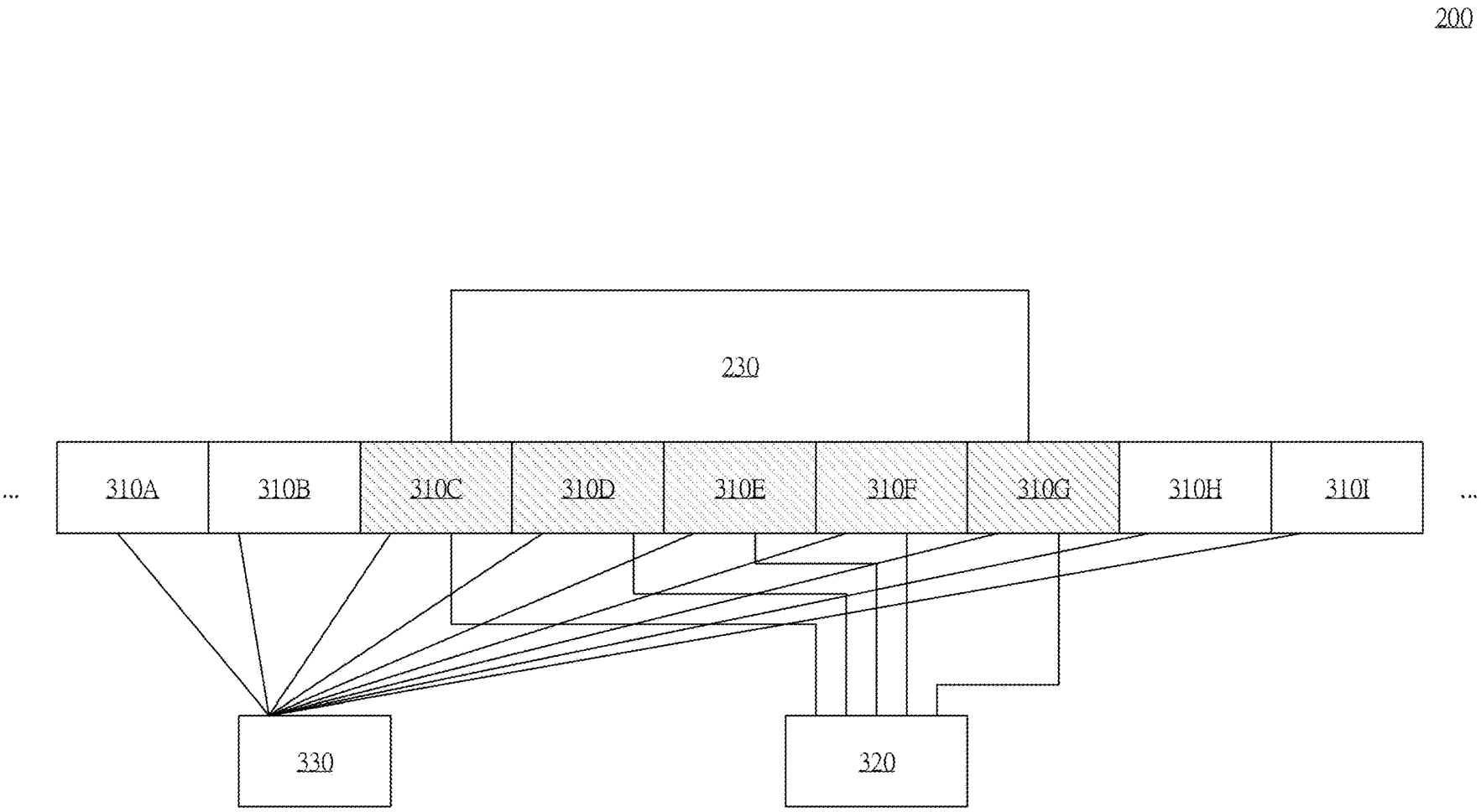
FIG. 3B is a variant of the embodiment as shown in the FIG. 3A.

Please refer to FIG. 3B, which is a variant of the embodiment as shown in the FIG. 3A. The element controller 320 is configured to connect to pixels 310C through 310G which are fully or partly covered by the element 230. The element controller 320 turns on all or part of the pixels 310 which are fully or partly covered by the element 230. Reversely, if the apparatus 200 needs to show information in full screen, the one or more element controller 320 is shut down and the display controller 330 is turned on to take charge. But the invention is not limited to, in another embodiment, the display controller 330 and the element controller 320 are integrated into one controller.

Figure 4B:
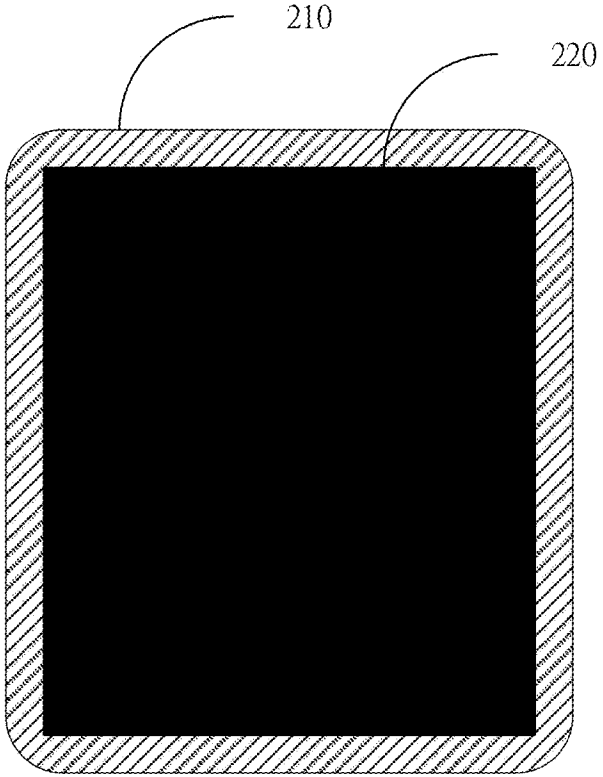
FIG. 4B depicts a view of the apparatus 200 operates in an idle mode in accordance with the present application.
Figure 4A:
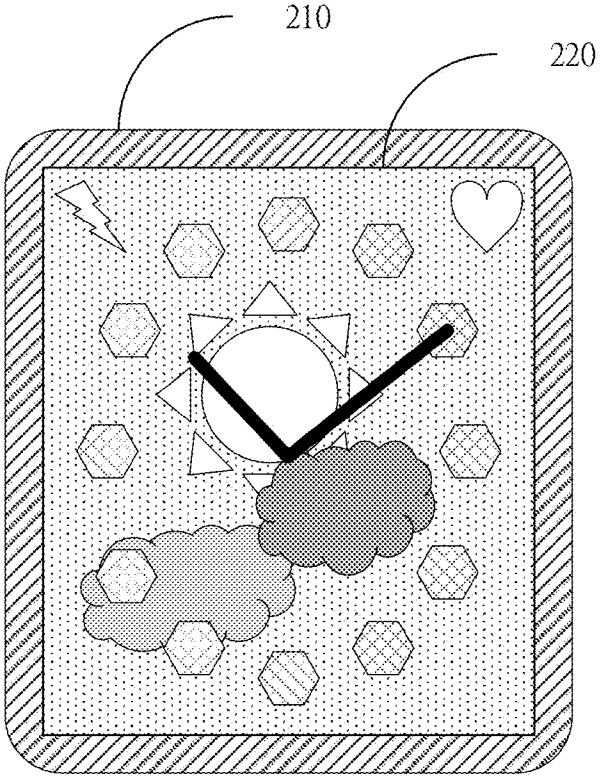
FIG. 4A depicts a view of the apparatus 200 operates in a normal mode in accordance with the present application.

Please refer to FIG. 4A, which depicts a view of the apparatus 200 operates in a normal mode in accordance with the present application. All of the pixels 310 of the OLED display 220 are turned on to display. In this embodiment, the display controller 330 is utilized to control all pixels 310 of the OLED display 220. Please note that an application program is presenting a clock showing an hour hand and a minute hand with regard to the dials made of the elements 230. In addition, a heart symbol is displayed at the upper right corner of the OLED display 220 to indicate that a heartbeat monitor of the apparatus 220 is functioning. An empty lightning symbol is displayed at the upper left corner of the OLED display 220 to remind user that the battery of the apparatus 220 is running out of power. In the middle of the OLED display 220, a picture drawing a sun and clouds shows weather forecast. In this normal mode, most or all of electrical components of the apparatus 220 are functioning. For ease and clarity of illustration, the embodiment of the FIG. 4A shows a scenario, but the invention is not limited to.

Please refer to FIG. 4B, which depicts a view of the apparatus 200 operates in an idle mode in accordance with the present application. When in the idle mode, at least the OLED display 220 of the apparatus 200 ceases functioning. In other words, all of the pixels of the OLED display 220 are turned off. Hence, the user sees a "black" OLED display 220 in this idle mode. Except for the OLED display 220, the display controller 330 as well as the element controller 320 are also turned off because they do not need to provide any control function to the OLED display 220. Furthermore, other electronic component of the apparatus 200 also ceases function in this idle mode. Of course, energy consumed by the apparatus 200 in the idle mode is much less than the energy consumed in the normal mode.

Please note that the elements 230 may be seen when the apparatus 200 is in the idle mode. Except for the light emitted from the OLED display 220, the elements 230 may also reflect, deflect, diffuse, filter, guide and/or split lights from surrounding environment. In this idle mode, the elements 230 may be treated as jewelries.

Figure 4D:
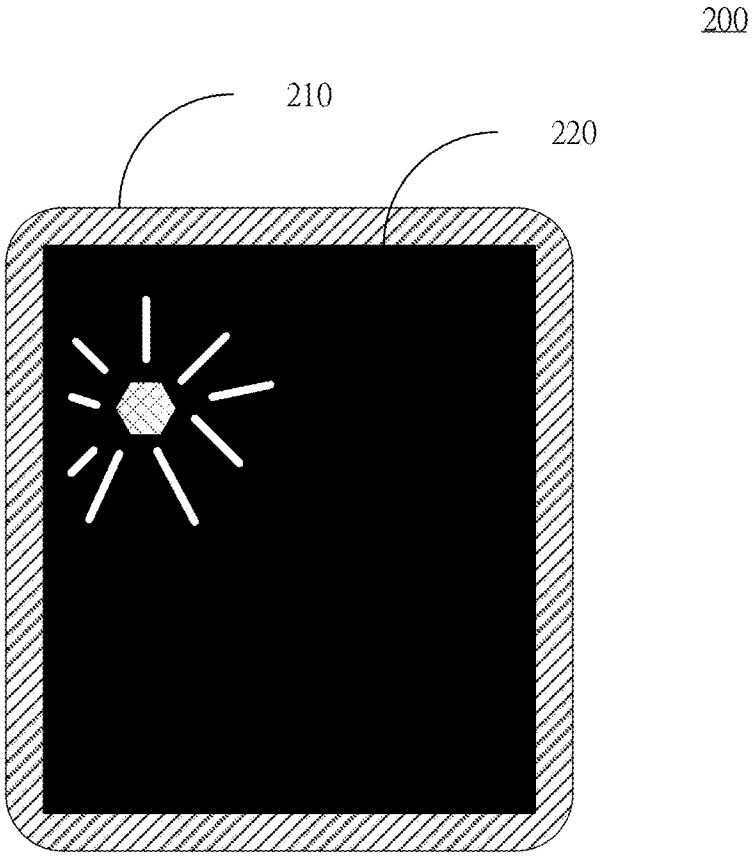
FIG. 4D depicts a view of the apparatus 200 operates in another timing mode in accordance with the present application.
Figure 4C:
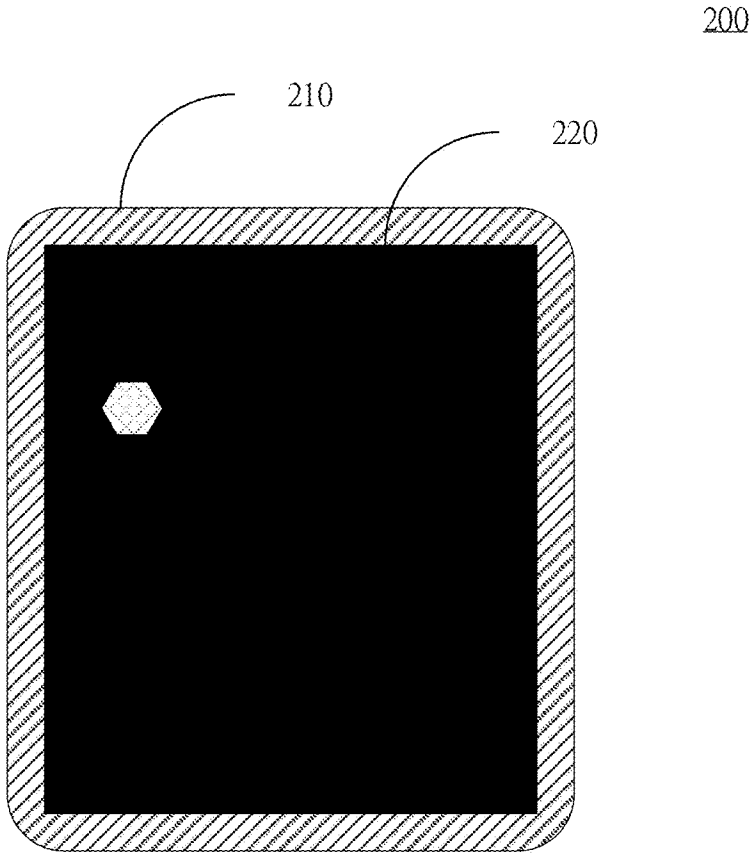
FIG. 4C depicts a view of the apparatus 200 operates in a timing mode in accordance with the present application.

Please refer to FIG. 4C, which depicts a view of the apparatus 200 operates in a timing mode in accordance with the present application. In this timing mode, most of the pixels of the OLED display 220 are turn off except for the pixels which are fully or partly covered by the element 230. Thus, power consumed by the OLED display 220 in the timing mode is less than in the normal mode. In this mode, the display controller 330 cease functioning and the element controller 320 controls the pixels which are fully or partly covered by the element 230. Hence, more power is saved by operating the element controller 320 instead of operating the display controller 330.

As shown in FIG. 4C, only pixels underlying to one element 230 acting as a 10 o'clock dial emit lights. In one embodiment, the lighting of the element 230 represents it is around 10 o'clock at the time. For example, the time is in a range between 9:31 and 10:30 or in another range between 9:55 and 10:05. Alternatively, the time is exactly 10 o'clock sharp.

In one embodiment, the brightness and/or the color of the pixels corresponding to the element 230 are modulated according to the time and/or any other parameters such as environmental ambient light. For example, when the apparatus 200 is in the dark, the brightness of the pixels may be adjusted downward. Reversely, when the apparatus 200 is under sun, the brightness of the pixels may be throttled to the maximum. In an alternative example, when the apparatus 200 is in a warmer environment, the color of the pixels may be closed to red, e.g. orange. If the apparatus 200 is in a cold environment, the color of the pixels may be closed to blue. In another embodiment, after the pixels are turned on, the brightness and/or the color of the pixels corresponding to the element 230 may be varied. The variation may be determined randomly.

If the user wants to know more precious time, pixels corresponding to two elements 230 may be turned on simultaneously. For example, a first element 230 shows red color represents the hour of the time and a second element 230 shows green color represents the minute. Furthermore, a third element 230 shows white color represents the second.

Please refer to FIG. 4D, which depicts a view of the apparatus 200 operates in another timing mode in accordance with the present application. Pixels corresponding to the elements 230 can be modulated to be blinking or flashing. Similar to the brightness and the color, the frequency of the blinking or flashing can be modulated or controlled by the display controller 330 or the element controller 320. For example, if the user sets an alarm at 10 o'clock, the pixels corresponding to the 10 o'clock element 230 go blinking or flashing at 10 o'clock.

Figure 4F:
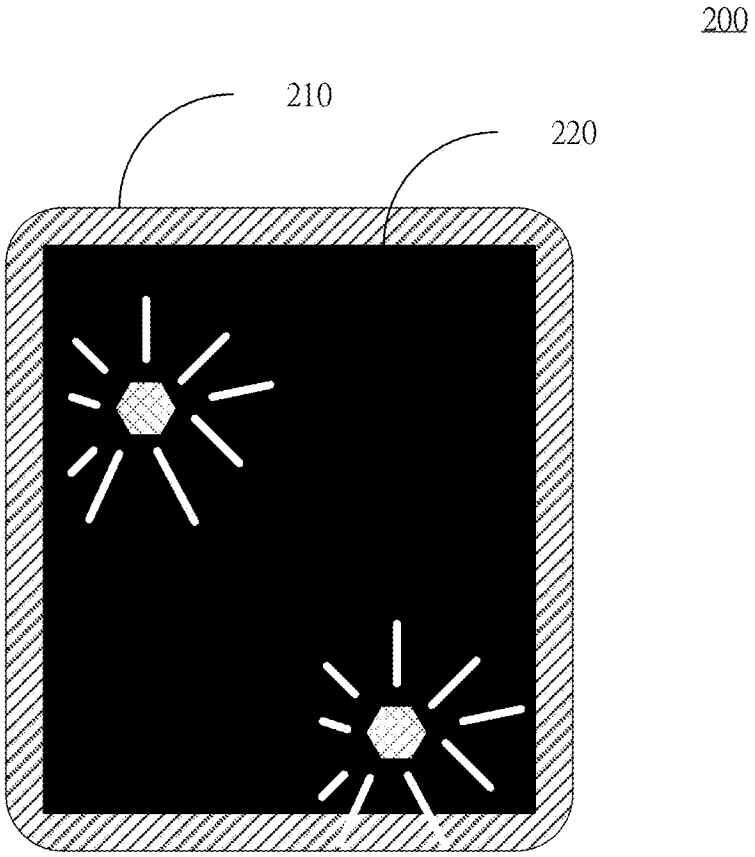
FIG. 4F depicts a view of the apparatus 200 operates in another timing mode in accordance with the present application.
Figure 4E:
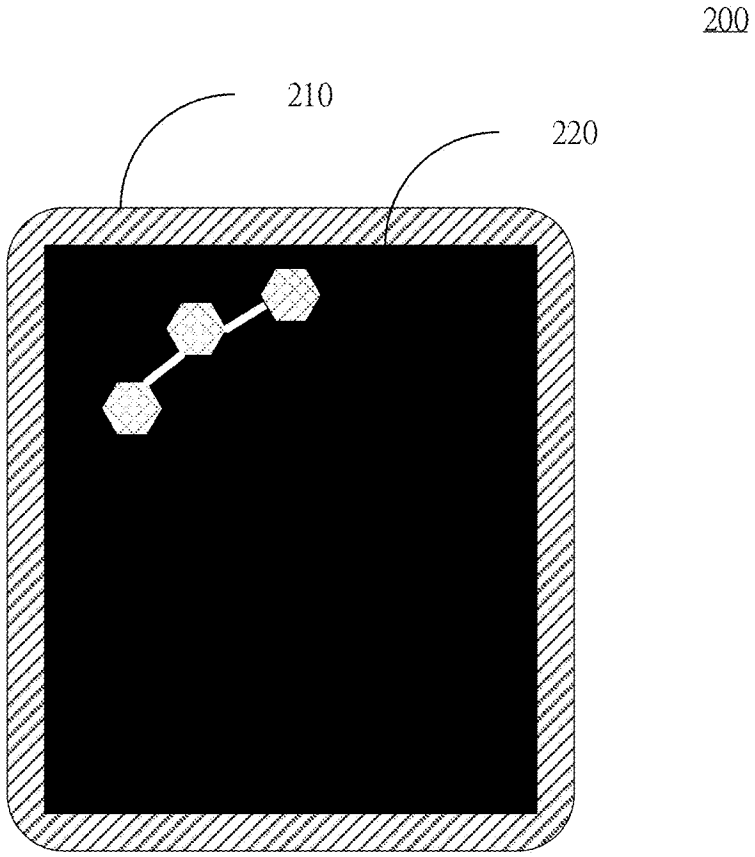
FIG. 4E depicts a view of the apparatus 200 operates in another timing mode in accordance with the present application.

Please refer to FIG. 4E, which depicts a view of the apparatus 200 operates in another timing mode in accordance with the present application. In additional to the pixels corresponding to the elements 230, few pixels uncovered by the elements 230 may be turned on in this timing mode. FIG. 4E illustrates an exemplary of displaying eleven o'clock; three elements 230 are connected by a curve line which is composed of pixels uncovered by the elements 230. In this timing mode, the display controller 330 has to be turned on to control the pixels forming the curve line. The brightness, color and/or frequency of blinking or flashing of each pixel can be modulated or controlled.

Please refer to FIG. 4F, which depicts a view of the apparatus 200 operates in another timing mode in accordance with the present application. Pixels corresponding to two of the elements 230 are blinking in order to represent hour and minute, respectively. In the embodiment, the frequency of blinking is different. For example, a lower blinking frequency presents the corresponding element to the hour. A higher blinking frequency presents the corresponding element to the minute. In another embodiment, the color of the pixels corresponding to two of the elements 230 are different. The red pixels presents the hour and the green presents the minute. In other embodiment, the quantity of pixels corresponding to two of the elements 230 are different. The quantity of pixels presents the hours is more than the quantity of pixels presents the minute. In other words, the lighting area corresponding to two of the element 230 is different. Furthermore, a much higher blinking frequency may present the corresponding element to the minute.

As shown in FIGS. 4C through 4F, there are different technical features described in these timing modes. Implementations of a variant of the timing modes in accordance with the present application may have any plausible combinations of the aforementioned technical features as shown in FIGS. 4C through 4F. With regard to the OLED display 220, it saves power in these timing modes. Besides, in the timing modes, the lightning of the elements 230 can highlight values of the elements 230 and the apparatus 200.

Figure 5A:
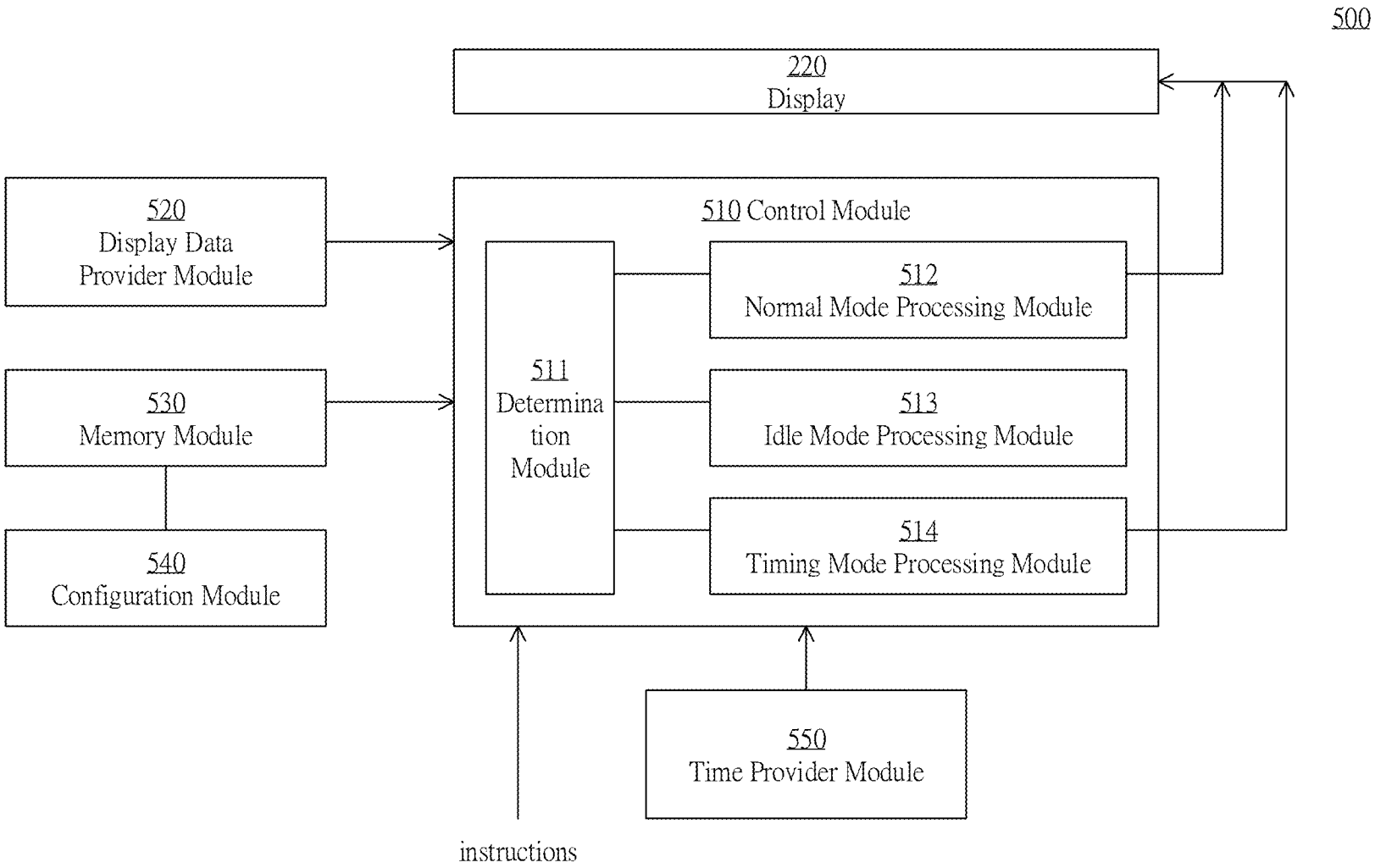
FIG. 5A illustrates a block diagram of an embodiment of an electronic apparatus 500 in accordance with the present application.

Please refer to FIG. 5A, which illustrates a block diagram of an embodiment of an electronic apparatus 500 in accordance with the present application. The electronic apparatus 500 comprises the OLED display 220. And the electronic apparatus 500 comprises the display controller 330 and/or one or more of the element control 320 for controlling the OLED display 220. In addition, the electronic apparatus 500 further comprises a control module 510, a display data provider module 520, a memory module 530, a configuration module 540 and a time provider module 550. The modules 510 through 550 are implemented by any plausible combinations of hardware and/or software. The hardware implementation comprises special tailored logic circuits and other circuits. The software implementation comprises a processor made of hardware, instructions and data stored in a memory and a system memory for instruction execution.

As shown in FIG. 5A, the control module 510 further comprises four modules including a determination module 511, a normal mode processing module 512, an idle mode processing module 513 and a timing mode processing module 514. According to instructions sent to the control module 510, the determination module 511 decides which one of the processing modules 512, 513 and 514 is operating accordingly.

The display data provider module 520 is configured for provide information to be shown in the OLED display 220 in the normal mode. For example, the image of the OLED display 220 as shown in FIG. 4A is provided by the display data provider module 520. If the control module 510 receives an instruction for entering the normal mode, the determination module 511 determines that the display data received by the control module 510 would be processed by the normal mode processing module 512. The normal mode processing module 512 forwards the display data to the OLED display 220. More specifically, the display data is forwarded to the display controller 330 which controls all of the pixels of the OLED display 220 to show the received display data.

If an instruction received by the control module 510 commands the determination module 511 to enter the idle mode, the idle mode processing module 513 is configured to inform the OLED display 220 to shutdown pixels and circuits. Thus, the OLED display 220 as well as its display controller 330 and/or one or more element controllers 320 are cut from power.

In case the determination module 511 determines that an instruction received is a command for entering any one of the timing modes, the determination module 511 would have the timing mode processing module 514 to take over the control of the OLED display 220. After being in the timing mode, the timing mode processing module 514 receives setting parameters from a memory module 530 and timing information from a time provider module 550.

The setting parameters stored in the memory module 530 include number of elements 230, pixels 310 corresponding to every element 230, o'clock dials corresponding to each element 230, one or more alarm times, modulations of brightness and color of the pixels 310 corresponding to the elements 230, frequency of blinking or flashing of elements 230 and/or any other parameters for fulfill the operations of the timing modes. The memory module 530 is implemented as a register file, volatile and/or non-volatile memory. The setting parameters are configurable, programmable, or hard-coded.

The time provider module 550 provides timing information to the control module 510. The timing information includes hour, minute and/or minute information. Preciseness of the timing information may be different in various implementations. As described already, the timing information comes from NTP server. Alternatively, the timing information comes from signals broadcasted by satellite navigation system like GPS, GLONASS, BEIDOU and any other constellations. In other embodiments, the timing information comes from terrestrial wireless telecommunication systems such as signals transmitted from base stations of 2G, 3G, 4G or 5G telecommunication systems. At last, the time provider module 550 has internal clock to maintain its own timing information. Regardless which sources of the timing information, the time provider module 550 provides it to the control module 510 in an adequate frequency. For example, if only hours can be told in the timing mode, the time provider module 550 may provide timing information per minute.

After collecting the setting parameters from the memory module 530 and the time provider module 550, the timing mode processing module 514 generates and transmits signals to the OLED display 220 to implement the timing modes and their variants as shown in FIGS. 4C through 4F according to the setting parameters.

If the setting parameters are configurable, the control module 510 further includes a configuration module 540 to set or to update the setting parameters stored in the memory module 530. At a given moment, only one of the three processing modules 512 through 514 of the control module 510 is operating. Rest of the processing modules does not operate in order to save power.

Figure 5B:
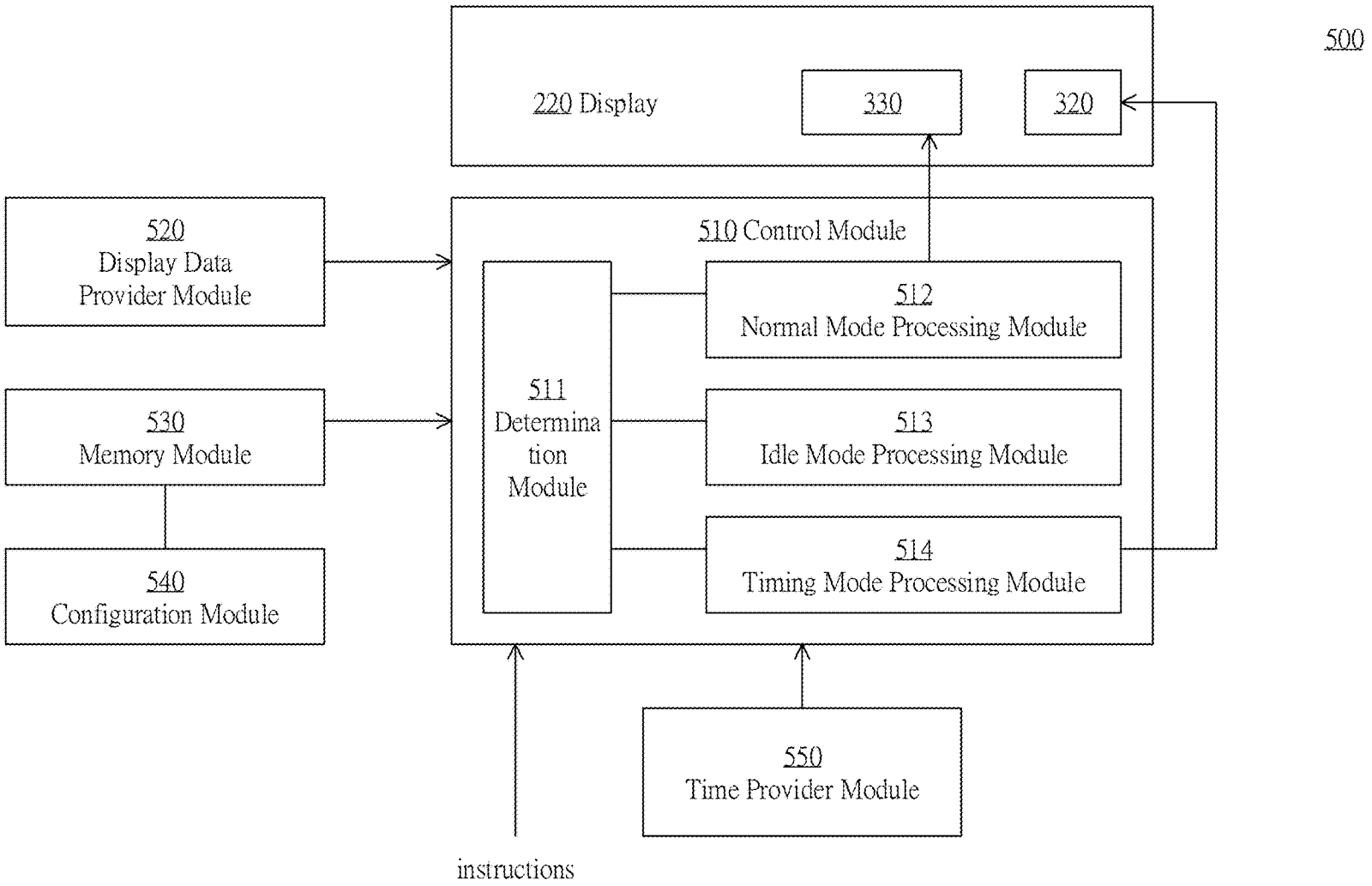
FIG. 5B illustrates a block diagram of an embodiment of another electronic apparatus 500 in accordance with the present application.

Please refer to FIG. 5B, which illustrates a block diagram of an embodiment of another electronic apparatus 500 in accordance with the present application. The normal mode processing module 512 is configured to connect to the display controller 330 of the OLED display 220. There is no need for the normal mode processing module 512 to connect to the element controller 320. Besides, the timing mode processing module 514 is configured to connect to the element controller 320 for implementations in one or more timing modes.

Figure 5C:
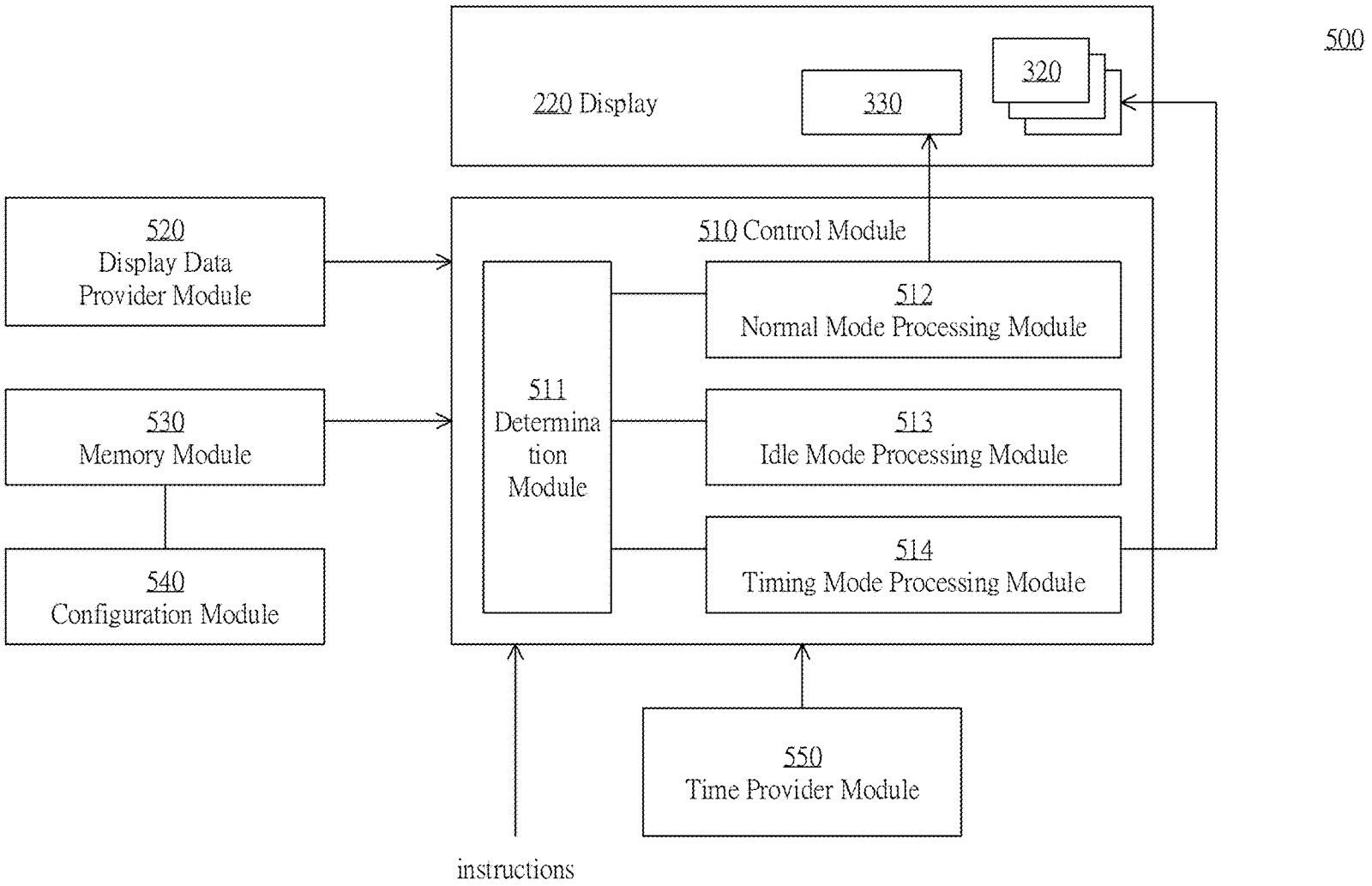
FIG. 5C illustrates a block diagram of an embodiment of another electronic apparatus 500 in accordance with the present application.

Please refer to FIG. 5C, which illustrates a block diagram of an embodiment of another electronic apparatus 500 in accordance with the present application. Comparing with the embodiment as shown in FIG. 5B, the timing mode processing module 514 is configured to multiple element controllers 320. Thus, the timing mode processing module 514 retains logic operations to control the element controllers 320 individually in this embodiment. In the embodiment as shown in FIG. 5B, the sole element controller 320 executes logic operations to control all of the pixels fully or partly covered by all of the elements 230. Regardless the logic operations for controlling pixels are implemented in either the timing mode processing module 514 or the element controller 320, in any one of the timing modes the apparatus 500 consumes less power than in the normal mode.

In the embodiments as shown in FIGS. 5A through 5C, the instructions sent to the control module 510 are generated according to a timer, an interrupt signal generated by an environmental sensor such as gyroscope, accelerometer, an output of a physical button, or an output from a touch processor. The timer provides a notification of a preset time alarm. The environmental sensor is used to detect a change of position or attitude of the apparatus 500. The button or the touch processor reports an input from user to the button or the touch screen, respectively. Changes internal or external to the apparatus 500 triggers changes of the three modes.

Figure 6A:
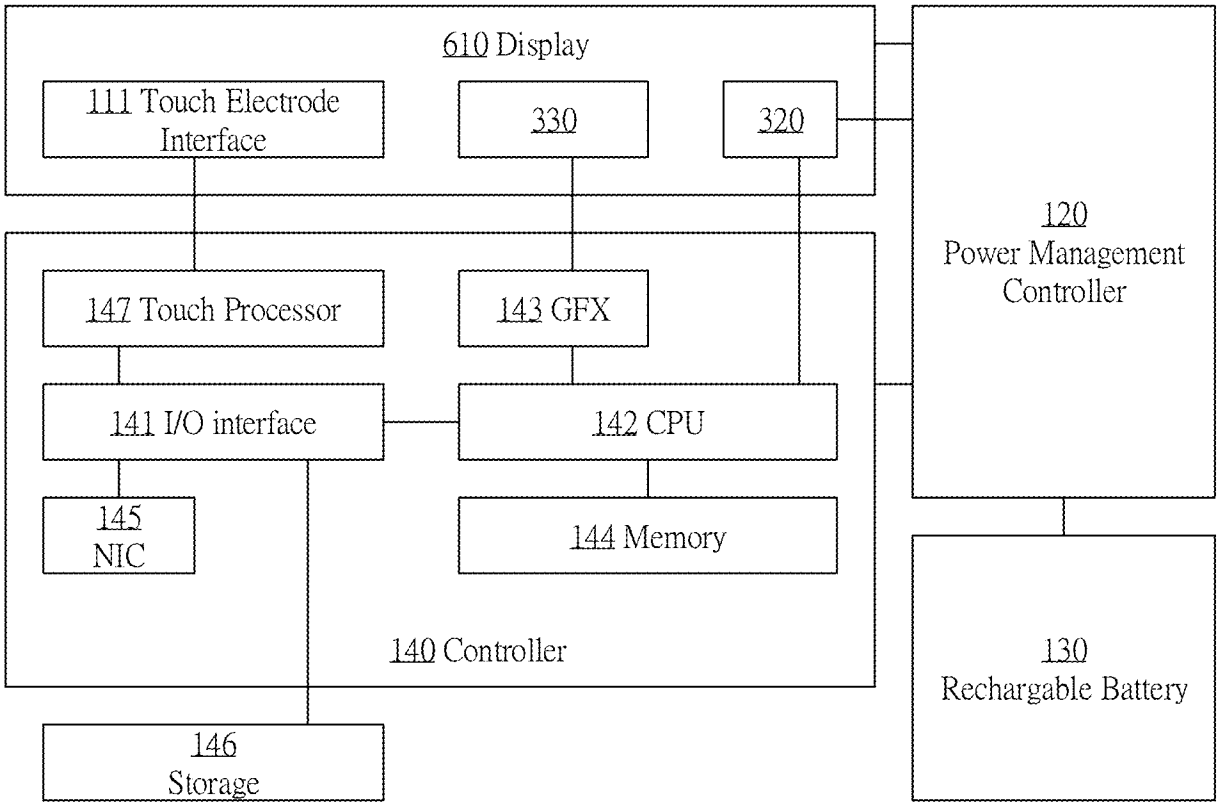
FIG. 6A illustrates a block diagram of an embodiment of an electronic apparatus 600 in accordance with the present application.

Please refer to FIG. 6A, which illustrates a block diagram of an embodiment of an electronic apparatus 600 in accordance with the present application. Comparing with FIG. 1, the embodiment as shown in FIG. 6A comprises a OLED display 610 instead of a touch screen 110 equipped with a traditional LCD. As discussed above, the OLED display 610 comprises a plurality of pixels 310 made of multiple OLEDs. All of these pixels 310 are under control of the display controller 330. And pixels 310 fully or partly covered by one or more element 230 may be controlled by one element controller 320.

In one embodiment, the optional graphics coprocessor 143 connects to the display controller 330 of the OLED display 610 to provide display information in the normal mode and/or in the timing mode. Alternatively, the CPU 142 may directly connect to the display controller 330 of the OLED display 610 to provide display information in the normal mode and/or in the timing mode.

The OLED display 610 includes one or more touch and/or pressure electrode layers for detecting touch events. The touch processor 147 connects to the electrodes of the electrode layers of the OLED display for detecting touch events. No matter any touch events detected or not, the touch processor 147 reports detection results to the CPU 142 in the normal mode. However, if operating in idle mode or in timing mode, the touch processor 147 is switched to a power saving mode to cease sensing touch event or to reduce sensing frequency, respectively, in order to save power. In case, the apparatus 600 switches back to the normal mode, the touch processor 147 is configured to restore to sense in normal sensing frequency.

As shown in FIG. 6A, the CPU 142 connects to the element controller 320 directly. When operating in the timing mode, the program application executed by the CPU 142 informs the GFX 143 and the display controller 330 being shut down to save power. And the control of the pixels partly or fully covered by the elements 230 is transferred to the element controller 320. The setting parameters are fed to the element controller 320 before switching to the timing mode. And the element controller 320 has an independent clock generator such as TCO, TCXO, TXO and other types of oscillator for generating a reference clock signal. Therefore the logic circuit of the element controller 320 controls the pixels and modulate brightness, color and/or blinking or flashing rate of each of the pixels to generate the technical features described in the embodiments as shown in FIGS. 4C through 4F.

After the control of the OLED display 610 is shifted to the element controller 320, the power management controller 120 cuts or reduces power supply to the controller 140 and the storage device 146 in the timing mode. Since most of the pixels not fully or partly covered by the elements 230 are shut down in the timing mode, the power consumed by the OLED display 610 is reduced significantly.

Alternatively, if the timing information sent to the element controller 320 from circuits of the controller 140, the circuit of the controller 140 for supplying the timing information is electrically isolated from other parts of the controller 140 in the timing mode. The power management controller 120 provides power to the circuit of the controller 140 for supplying the timing information to the element controller 320.

Figure 6B:
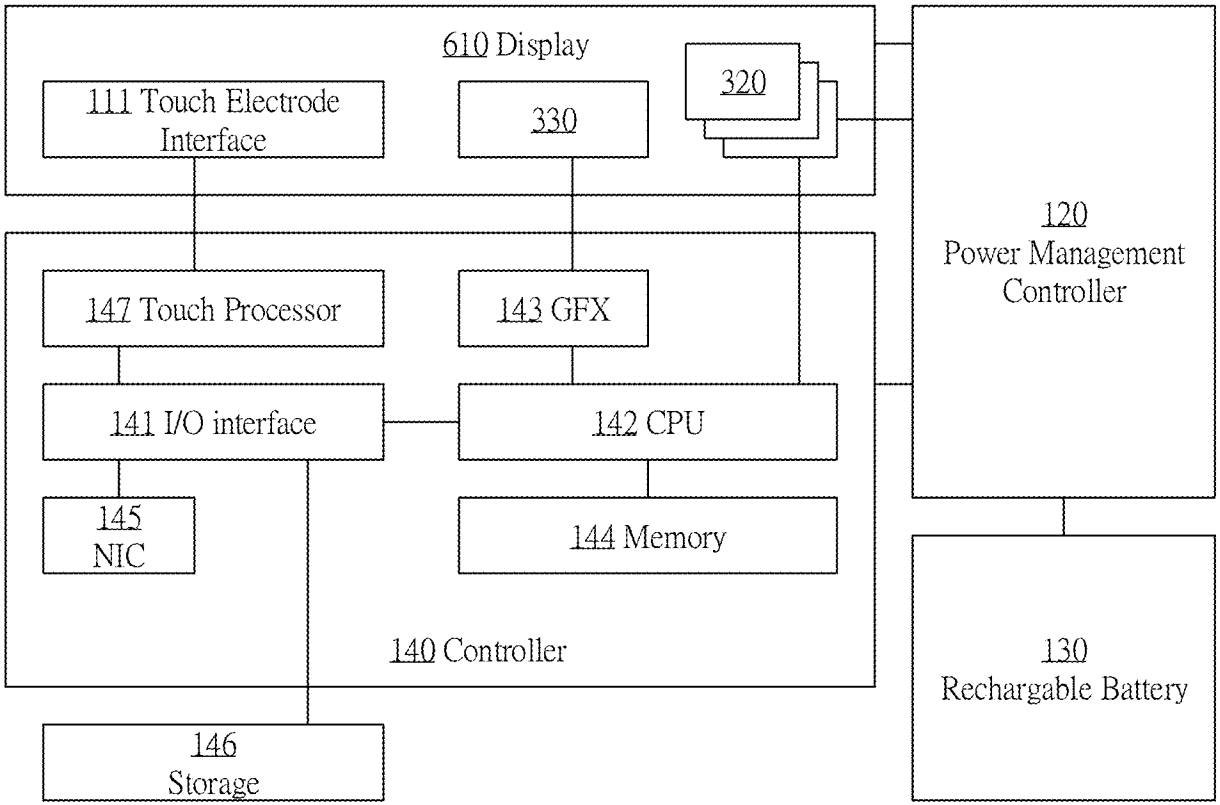
FIG. 6B illustrates a block diagram of a variant of the electronic apparatus 600 in accordance with the present application.

Please refer to FIG. 6B, which illustrates a block diagram of a variant of the electronic apparatus 600 in accordance with the present application. Comparing with the embodiment as shown in FIG. 6A, the CPU 142 connects to multiple element controllers 320 and to the display controller 330 directly or indirectly via the GFX 143. When entering the timing mode, the CPU 142 needs to remain operating for sending commands to at least one of the element controllers 320 according to the setting parameters and the timing information. Although the apparatus 600 as shown in FIG. 6B consumes more power than the apparatus 600 as shown in FIG. 6A in the timing mode, it provides maximum programming flexibility to manipulate the lighting of the elements 230 and/or other pixels 310 not covered by the elements 230. For example, the embodiment as shown in FIG. 4E is able to be realized by the embodiment because the application program executed by the CPU 142 is able to lite on the curve line which is comprised of pixels not covered by the elements 230. Nevertheless, in the timing mode, the power management controller 120 shuts down other electronic components such as NIC 145 and the touch processor 147 in this embodiment as shown in FIG. 6B. Moreover, in the timing mode the CPU 142 may be operating in a power-saving mode by reducing the operating frequency or shut down parts of circuits irrelevant to the controls of pixels.

Although the element controller 320 as shown in FIG. 6B is connected to the CPU 142 directly, the connection between these two components are made in other ways. For example, the element controller 320 connects to the CPU 142 via the I/O controller 141. Or the element controller 320 may connects to the CPU via the GFX 143.

Figure 6C:
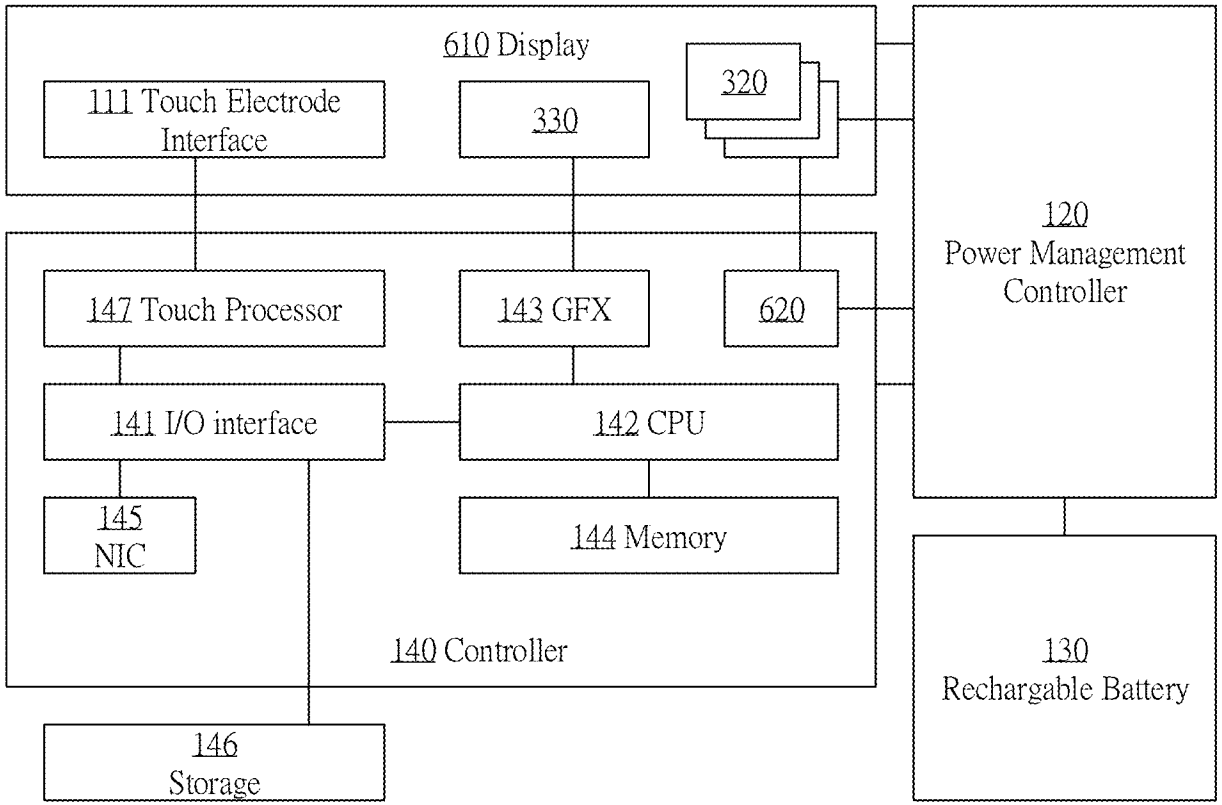
FIG. 6C illustrates a block diagram of a variant of the electronic apparatus 600 in accordance with the present application.

Please refer to FIG. 6C, which illustrates a block diagram of a variant of the electronic apparatus 600 in accordance with the present application. Comparing with the embodiment as shown in FIG. 6A, a timing mode processor 620 is added into the controller 140. The timing mode processor 620 connects to one element controller 320 directly or indirectly for controlling the pixels fully or partly covered by the elements 230.

In one embodiment, the timing mode processor 620 is implemented in any plausible combinations of hardware and software. For example, the timing mode processor 620 is implemented as the timing mode processing module 514 as shown in FIG. 5C. In order to realize the timing mode features, the timing mode processor 620 reads in setting parameters from the memory 144 and/or from the storage device 146. And the timing mode processor 620 has an independent clock generator such as TCO, TCXO, TXO and other types of oscillator for generating a reference clock signal. After receiving an instruction from the CPU 142 for entering timing mode, the timing mode processor 620 provides controls to the element controller 320. In this embodiment, the power management controller 120 is able to shut down the rest parts of the controller 140 for saving power. Only the timing mode processor 620, the element controller 320 and few pixels covered by the elements 230 are activated in the timing mode.

Figure 6D:
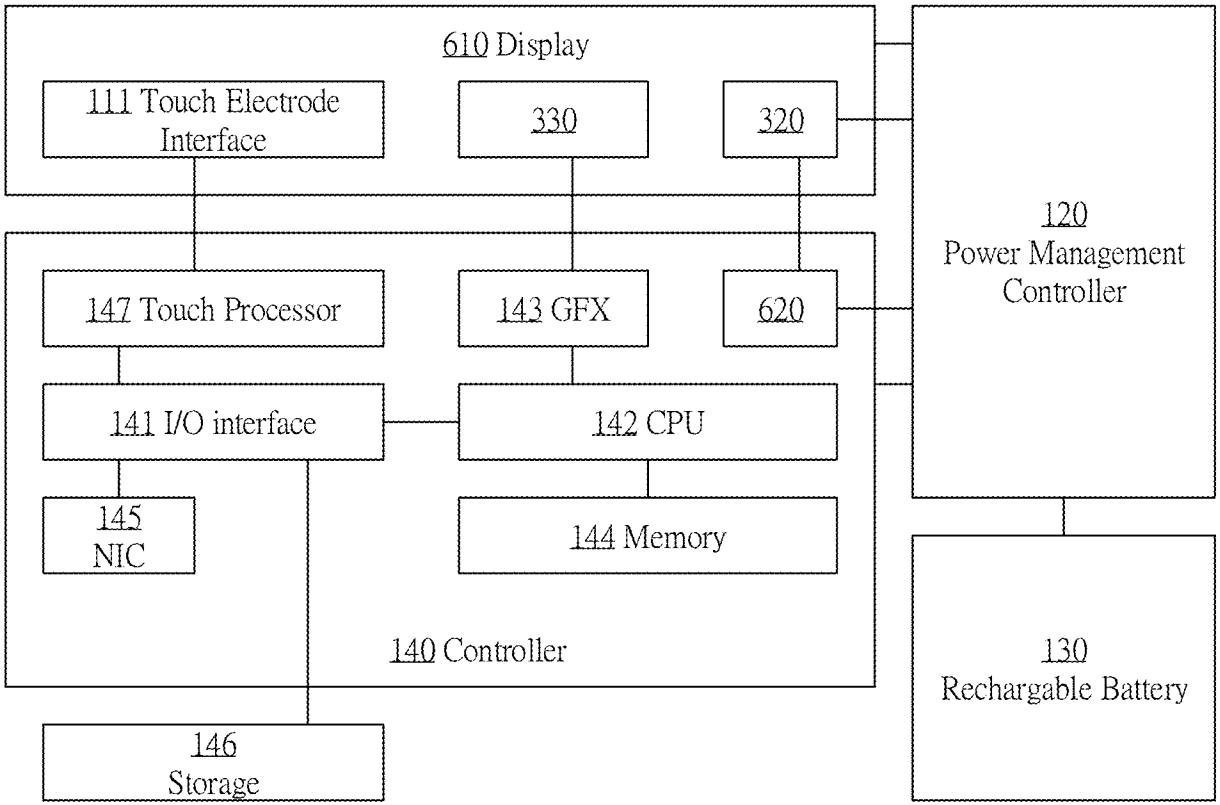
FIG. 6D illustrates a block diagram of a variant of the electronic apparatus 600 in accordance with the present application.

Please refer to FIG. 6D, which illustrates a block diagram of a variant of the electronic apparatus 600 in accordance with the present application. Comparing with the embodiment as shown in FIG. 6C, the timing mode processor 620 connects to more than one element controller 320 directly or indirectly for controlling the pixels fully or partly covered by the elements 230. In this embodiment, the control logic of multiple element controllers 320 is implemented in the timing mode processor 620, which is programmable. The instructions and data of the control logic are stored in a separate memory of the timing mode processor 620 or in the memory 144 shared with the CPU 142. Regardless where the instructions and data stores, they may be configurable to maximum programming flexibility to control the pixels covered by the elements 230.

Figure 7A:
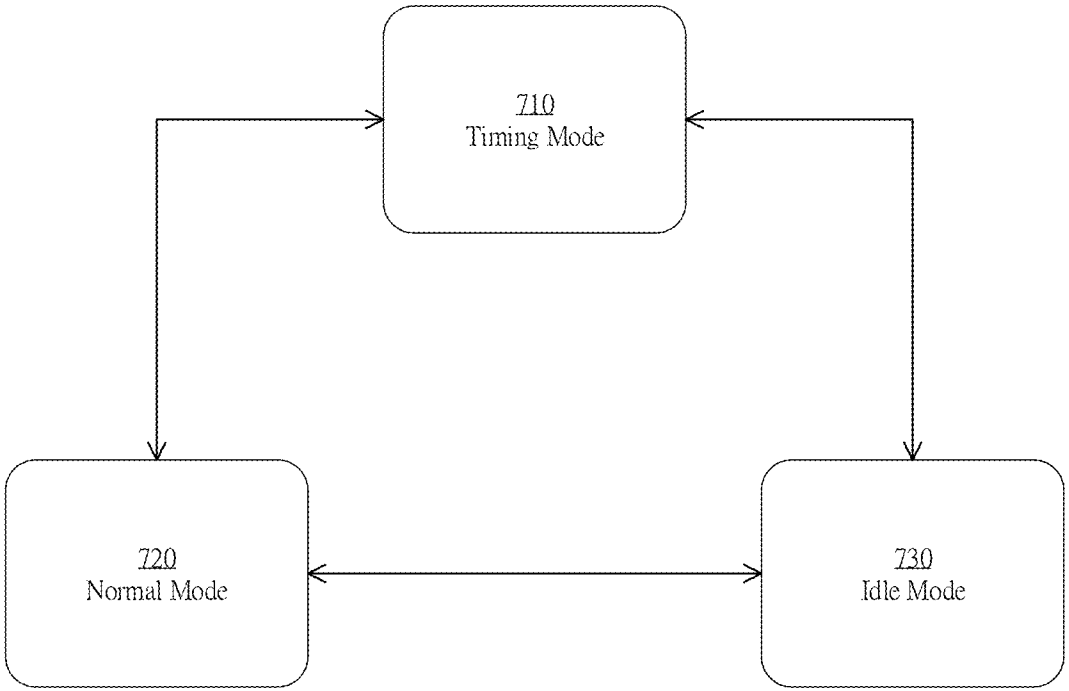
FIG. 7A shows a state machine diagram of an embodiment in accordance with the present application.

Please refer to FIG. 7A, which shows a state machine diagram of an embodiment in accordance with the present application. For the OLED display, there are three operating modes, i.e., the timing mode 710, the normal mode 720 and the idle mode 730 in the three-state machine which are implemented by the apparatus 200, 500 and 600 provided by the present application. Ideally, no matter the apparatus is in any one of the three modes, it switches to another mode. For example, the apparatus is able to switch to the timing mode from the normal mode. However, the free switching mechanism between these three operating modes as show in FIG. 7A may introduce confusions of user. The present application provides a modification of the state machine later.

Figure 7B:
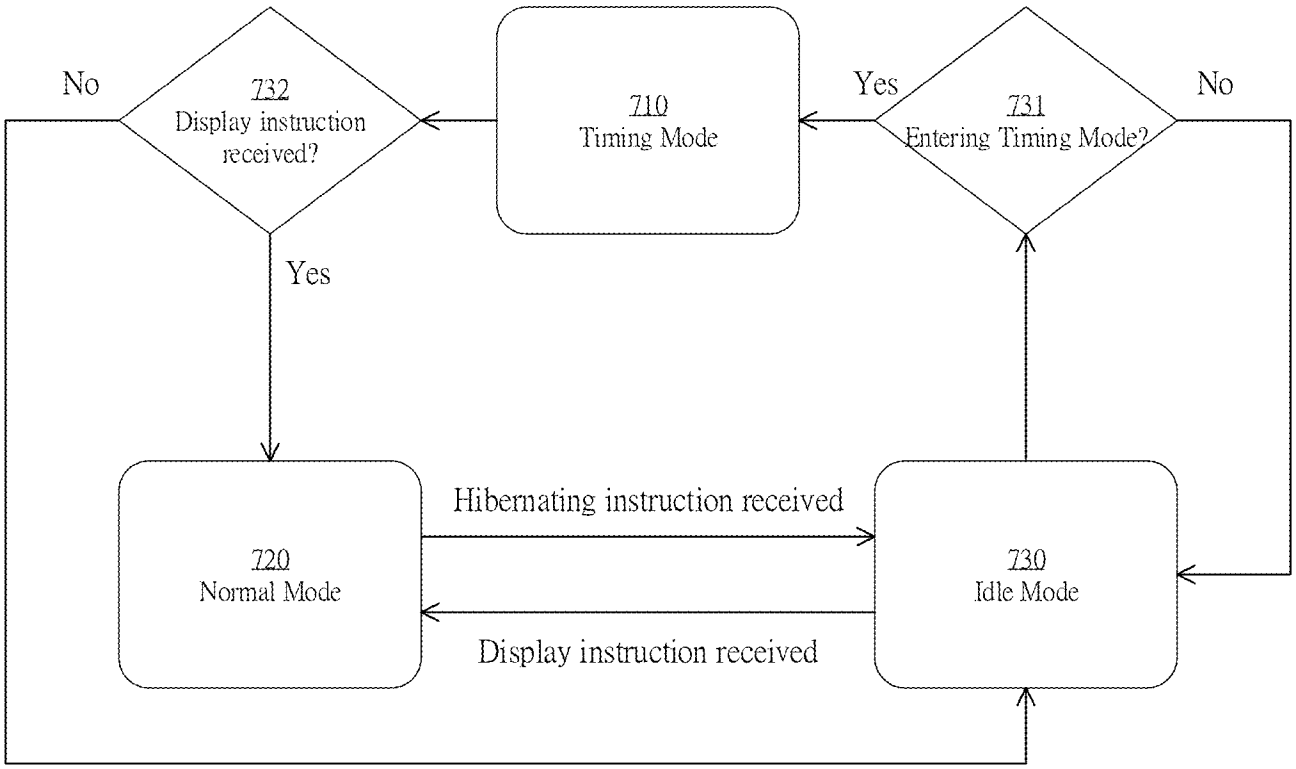
FIG. 7B shows another state machine diagram of another embodiment in accordance with the present application.

Please refer to FIG. 7B, which shows another state machine diagram of another embodiment in accordance with the present application. In this state machine, the timing mode 710 can be entered only from the idle mode 730. The idle mode 730 enters into timing mode 710 via the confirmation at the 731. It is not allowed to switch to the timing mode 710 from the normal mode 720. When in the normal mode, it goes to the idle mode if a hibernating instruction is given. For example, in the embodiments as shown in FIGS. 5A through 5C, the determination module 511 deactivates the idle mode processing module 512 and activates the normal mode processing module 511 after receiving the hibernating instruction.

While in the idle mode, the determination module 511 determines whether an instruction for entering the timing mode is received as shown at the step 731. The determination is performed periodically. If the received instruction is determined such as an instruction, the determination module 511 deactivates the idle mode processing module 513 and activates the timing mode processing module 514 accordingly. If no such instruction is received at the step 731, the determination module 511 remains the mode unchanged. Or if a display instruction is received, the determination module 511 deactivates the idle mode processing module 513 and activates the normal mode processing module 512 accordingly.

After entering the timing mode, the determination module 511 further determines whether an instruction is received for changing mode as shown at the step 732. If an instruction is received and is determined as a display instruction, the determination module 511 activates the normal mode processing module 512 and deactivates the timing mode processing module 514. However, if an instruction other than the display instruction is received, the determination module 511 activates the idle mode processing module 513 and deactivates the timing mode processing module 514.

Although the state machine and the steps as shown in FIG. 7B implemented by the embodiments shown in FIGS. 5A through 5C are described, the state machines as shown in FIGS. 7A and 7B can be implemented by the embodiments shown in FIGS. 6A through 6D. The determination steps 731 and 732 are performed by the program application executed by the CPU 142 which is operated in a power-saving mode in the embodiment shown in FIGS. 6A and 6B. The determination step 732 is also performed by the instructions executed by the timing mode processor 602 in the embodiment shown in FIGS. 6C and 6D. While the determination step 731 is performed by the program application executed by the CPU 142 which may be operated in the power-saving mode in the embodiment shown in FIGS. 6C and 6D.

The above embodiments are only used to illustrate the principles of the present invention, and they should not be construed as to limit the present invention in any way. The above embodiments can be modified by those with ordinary skill in the art without departing from the scope of the present invention as defined in the following appended claims.

What is claimed is:

1. An electronic apparatus, comprising:

a display comprising a plurality of pixels including a first pixel and a second pixel;

a first element above said first pixel, wherein said first element provides visual effect on light emitted from said first pixel;

an operation controller for selectively turning on or off said first pixel and said second pixel;

an idle mode processing module for operating an idle mode by turning off both first pixel and said second pixel;

a normal mode processing module for operating a normal mode by turning on both said first pixel and said second pixel;

a timing mode processing module for operating a timing mode by turning on said first pixel and turning off said second pixel; and a determination module for receiving and determining an instruction indicating which one of said idle mode, said normal mode, and said timing mode to be executed.

2. The electronic apparatus of claim 1, wherein said first element is a jewelry or a fine stone.

3. The electronic apparatus of claim 1, wherein said display is a light emitting diode (LED) display, an organic LED, or a micro LED.

4. The electronic apparatus of claim 1, wherein said operation controller turns on said first pixel according to a parameter of brightness, color, blinking frequency, and a combination thereof.

5. The electronic apparatus of claim 1, further comprising:

a second element; and a third pixel under said second element;

wherein said operation controller turns on pixels between said first pixel and said third pixel under said timing mode.

6. The electronic apparatus of claim 5, wherein said operation controller turns on pixels sequentially back and forth between said first pixel and said third pixel under said timing mode.

7. The electronic apparatus of claim 5, wherein said operation controller turns on pixels with different colors or brightness between said first pixel and said third pixel under said timing mode.

8. The electronic apparatus of claim 1, further comprising:

a second element; and a third pixel;

wherein said operation controller turns on said first pixel for indicating hours with a first brightness, a first color, or a first blinking frequency, and turning on said third pixel for indicating minutes with a second brightness, a second color, or a second blinking frequency.

9. The electronic apparatus of claim 8, wherein said third pixel is under said second element.

10. The electronic apparatus of claim 1, further comprising a transparent cover layer on said display, wherein said first element is embedded within said transparent cover layer.

11. The electronic apparatus of claim 1, further comprising a transparent cover layer on said display, wherein said first element is positioned on said transparent cover layer.

12. An electronic apparatus, comprising:

a display comprising a display controller, an element controller, and a plurality of pixels including a first pixel and a second pixel, wherein said display controller controls all pixels, and said element controller for controlling said first pixel;

a first element above said first pixel, wherein said first element provides visual effect on light emitted from said first pixel; and wherein under a first mode, while said display controller deactivates said plurality of pixels, said first pixel is controlled and activated by the element controller for conserving energy; and wherein under a second mode, the display controller activates said plurality of pixels.

13. A method for operating an electronic apparatus comprising a plurality of pixels including a first pixel and a second pixel, wherein said first pixel is under a first element, the method comprising:

operating said electronic apparatus in an idle mode by turning off both first pixel and said second pixel;

operating said electronic apparatus in a normal mode by turning on both said first pixel and said second pixel;

operating said electronic apparatus in a timing mode by turning on said first pixel and turning off said second pixel; and receiving and determining an instruction by determination module, wherein said instruction indicates which one of said idle mode, said normal mode, and said timing mode to be executed;

wherein said first element provides visual effect on light emitted from said first pixel.

14. The method of claim 13, wherein said first pixel and said second pixel are turned on according to a parameter of brightness, color, blinking frequency, and a combination thereof.

15. The method of claim 14, wherein said electronic apparatus further comprises a second element and a third pixel under said second element, and the method further comprises:

turning on pixels between said first pixel and said third pixel under said timing mode.

16. The method of claim 15, further comprising:

turning on pixels sequentially back and forth between said first pixel and said third pixel under said timing mode.

17. The method of claim 15, further comprising:

turning on pixels with different colors or brightness between said first pixel and said third pixel under said timing mode.

18. The method of claim 15, wherein said electronic apparatus further comprises a second element and a third pixel, and the method further comprises:

turning on said first pixel for indicating hours with a first brightness, a first color, or a first blinking frequency, and turning on said third pixel for indicating minutes with a second brightness, a second color, or a second blinking frequency.

19. The method of claim 18, wherein said third pixel is under said second element.

* * * * *